US011817646B2

(12) United States Patent
Chen

(10) Patent No.: US 11,817,646 B2
(45) **Date of Patent: *Nov. 14, 2023**

(54) CONDUCTIVE TERMINAL ASSEMBLY AND CONDUCTIVE TERMINAL

(71) Applicant: Sung-Yu Chen, Taichung (TW)

(72) Inventor: Sung-Yu Chen, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/684,359

(22) Filed: Mar. 1, 2022

(65) Prior Publication Data

US 2022/0294144 A1 Sep. 15, 2022

Related U.S. Application Data

(60) Provisional application No. 63/158,390, filed on Mar. 9, 2021.

(51) Int. Cl.
*H01R 12/58* (2011.01)
*H01R 13/11* (2006.01)

(52) U.S. Cl.
CPC ..... *H01R 13/113* (2013.01); *H01R 12/58* (2013.01)

(58) Field of Classification Search
CPC ..... H01R 13/113; H01R 12/58; H01R 31/02; H01R 12/714; H01R 13/112; H01R 13/2457; H01R 13/02; H01R 12/716; H01R 13/11; H01R 13/652
See application file for complete search history.

(56) References Cited

U.S. PATENT DOCUMENTS

| | | | | |
|---|---|---|---|---|
| 7,775,822 | B2 * | 8/2010 | Ngo | H01R 12/7088 439/290 |
| 8,926,375 | B2 * | 1/2015 | Chen | H01R 13/26 439/682 |
| 9,666,962 | B1 * | 5/2017 | Bucher | H01R 12/585 |
| 9,735,526 | B1 * | 8/2017 | Chen | H01R 12/7088 |
| 10,128,587 | B2 * | 11/2018 | Ho | H01R 13/2492 |
| 10,411,382 | B2 * | 9/2019 | Sichmann | H01R 13/113 |
| 10,673,161 | B1 * | 6/2020 | Mullert | H01R 12/7082 |
| 11,631,951 | B2 * | 4/2023 | Wang | H01R 12/716 439/345 |
| 2004/0029408 | A1 * | 2/2004 | Brown, III | H01R 12/716 439/65 |
| 2004/0147177 | A1 * | 7/2004 | Wagner | H01R 13/113 439/855 |

(Continued)

*Primary Examiner* — Truc T Nguyen
(74) *Attorney, Agent, or Firm* — Li & Cai Intellectual Property Office

(57) ABSTRACT

A conductive terminal assembly and a conductive terminal are provided. The conductive terminal assembly includes a first conductive terminal and a second conductive terminal that are not in contact with each other. The first conductive terminal includes a first A contact portion, a first B contact portion, a first extension portion, and a first pin portion. The first A contact portion includes at least one first A contact arm. The second conductive terminal includes a second A contact portion, a second B contact portion, a second extension portion, and a second pin portion. The second A contact portion includes at least one second A contact arm. The first A contact portion and the second A contact portion are arranged side by side and form a first port. The first B contact portion and the second B contact portion are arranged side by side and form a second port.

20 Claims, 15 Drawing Sheets

(56) References Cited

U.S. PATENT DOCUMENTS

| | | | | |
|---|---|---|---|---|
| 2012/0077359 | A1* | 3/2012 | Yamamoto | H05K 3/4046 439/78 |
| 2013/0090025 | A1* | 4/2013 | Trout | H01R 4/028 439/884 |
| 2017/0149179 | A1* | 5/2017 | Li | H01R 13/6271 |

* cited by examiner

CONDUCTIVE TERMINAL ASSEMBLY AND CONDUCTIVE TERMINAL

CROSS-REFERENCE TO RELATED PATENT APPLICATION

This application claims priority to the U.S. Provisional Patent Application Ser. No. 63/158,390 filed on Mar. 9, 2021, which application is incorporated herein by reference in its entirety.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an electrical connector, and more particularly to an electrical connector with a conductive terminal assembly capable of performing a current shunting function.

BACKGROUND OF THE DISCLOSURE

In the related art, an electrical connector for supplying a current usually transmits the current through only a single output interface. Using a board-side electrical connector as an example, when the board-side electrical connector transmits a current to a circuit board, the current is shunted by the circuit board for providing a required shunt current to electronic components on the circuit board. However, if a high current is supplied and shunted through the circuit board, a current-carrying capacity of the circuit board needs to be increased. In addition, power loss can occur during shunting of the current through the circuit board.

Therefore, how to improve the supply of board-side electrical connectors by improving a structural design has become an issue to be resolved in this technical field.

SUMMARY OF THE DISCLOSURE

In response to the above-referenced technical inadequacies, the present disclosure provides an electrical connector with a conductive terminal assembly capable of performing a current shunting function, which can additionally shunt a current to other components in a single electrical connector, so as to save space of an electronic apparatus.

In one aspect, the present disclosure provides a conductive terminal assembly, which includes a first conductive terminal and a second conductive terminal. The first conductive terminal includes a first A contact portion, a first B contact portion, a first extension portion, and a first pin portion. The first A contact portion, the first B contact portion, and the first pin portion are connected to the first extension portion. The first A contact portion includes at least one first A contact arm. The at least one first A contact arm extends along a first direction. The first B contact portion extends along a second direction. The first pin portion extends along a third direction. The first direction is perpendicular to the second direction and the third direction. The second direction and the third direction are parallel to each other and in opposite directions. The second conductive terminal is arranged side by side with the first conductive terminal. The second conductive terminal includes a second A contact portion, a second B contact portion, a second extension portion, and a second pin portion. The second A contact portion, the second B contact portion, and the second pin portion are connected to the second extension portion. The second A contact portion includes at least one second A contact arm. The at least one second A contact arm extends along the first direction. The second B contact portion extends along the second direction. The second pin portion extends along the third direction. The first conductive terminal and the second conductive terminal are each integrally formed and not in contact with each other. The first A contact portion and the second A contact portion are arranged side by side and form a first port. The first port is used for a first mating assembly to be plugged in. The first B contact portion and the second B contact portion are arranged side by side and form a second port. The second port is used for a second mating assembly to be plugged in. The first pin portion and the second pin portion are used for being plugged into a circuit board.

In another aspect, the present disclosure provides a conductive terminal, which includes an A contact portion, a B contact portion, an extension portion, and a pin portion. The A contact portion includes at least one A contact arm, and the at least one A contact arm extends along a first direction. The B contact portion extends along a second direction. The pin portion extends along a third direction. The extension portion is connected to the A contact portion, the B contact portion, and the pin portion. The A contact portion, the B contact portion, the extension portion, and the pin portion are integrally formed. The first direction is perpendicular to the second direction and the third direction. The second direction and the third direction are parallel to each other and in opposite directions.

Therefore, in the conductive terminal assembly and the conductive terminal provided by the present disclosure, the first A contact portion and the second A contact portion are arranged side by side and form the first port for the first mating assembly to be plugged in, the first B contact portion and the second B contact portion are arranged side by side and form the second port for the second mating assembly to be plugged in, and the first pin portion and the second pin portion are used for being plugged into the circuit board, so as to provide an electrical connector with a conductive terminal assembly capable of performing a current shunting function, which can additionally shunt a current to other components in a single electrical connector. In this way, the space of the electronic apparatus can be saved.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
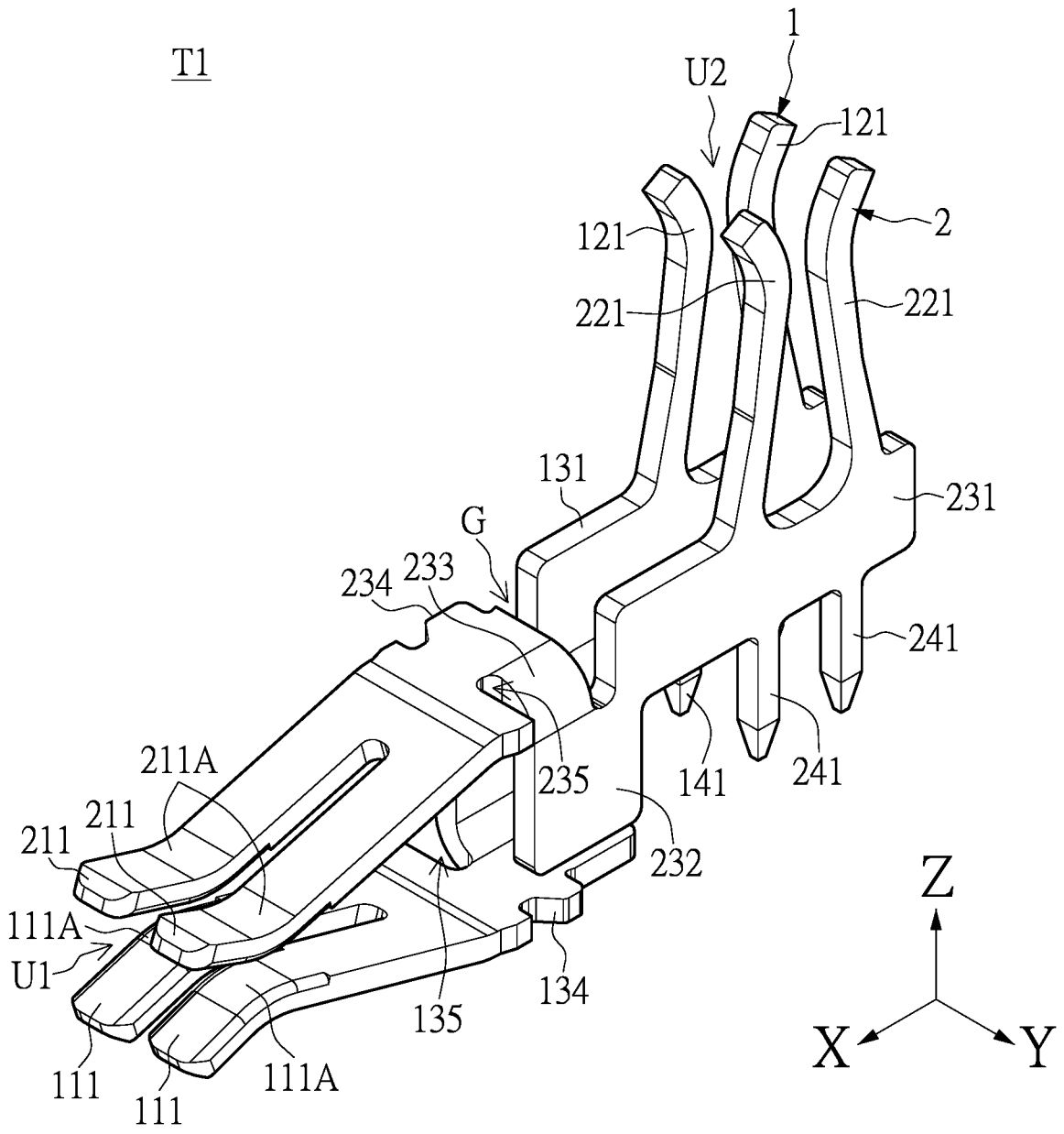
FIG. 1 is a three-dimensional schematic view of a conductive terminal assembly according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
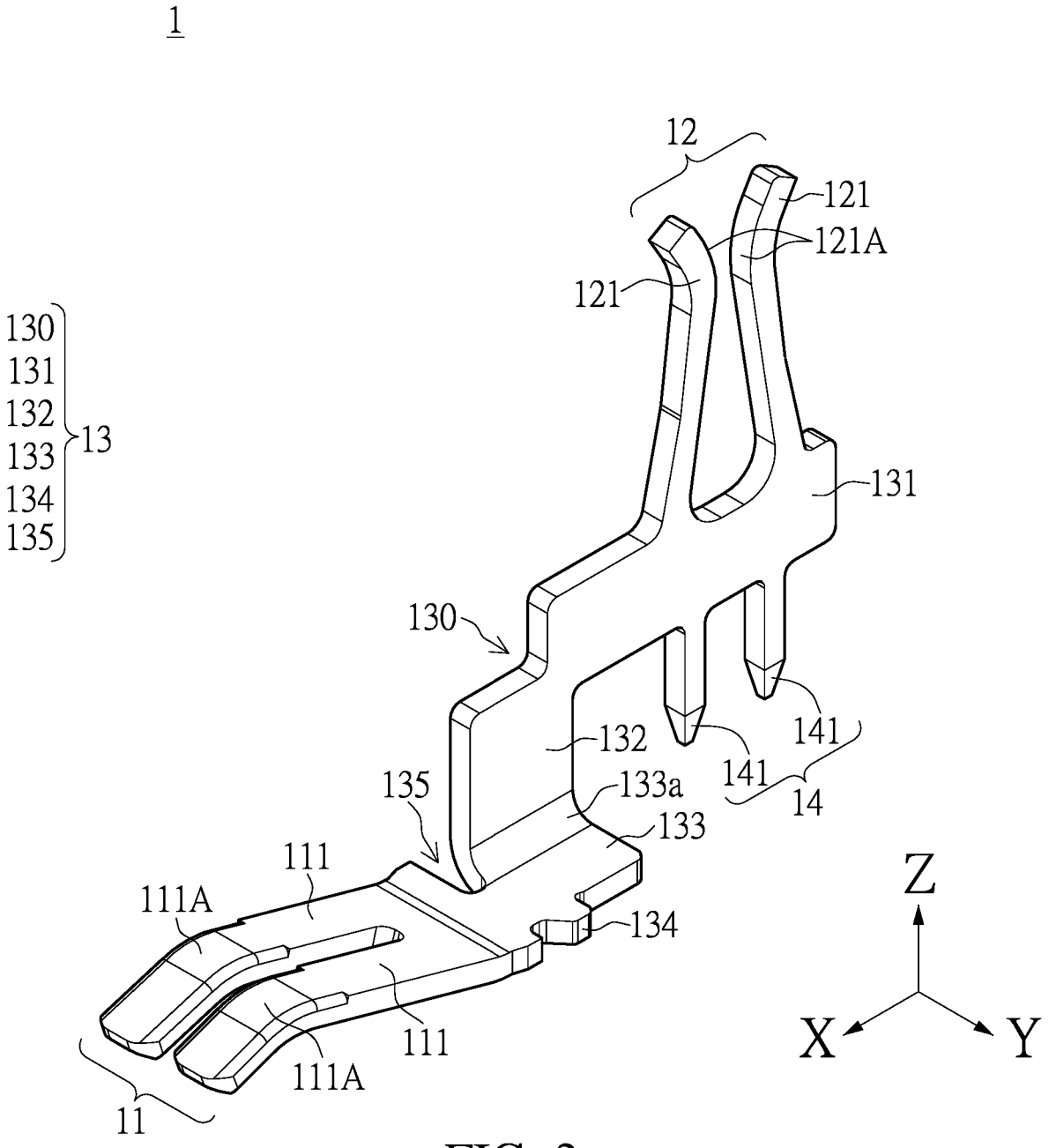
FIG. 2 is a three-dimensional schematic view of a first conductive terminal according to the first embodiment of the present disclosure.
Figure 3:
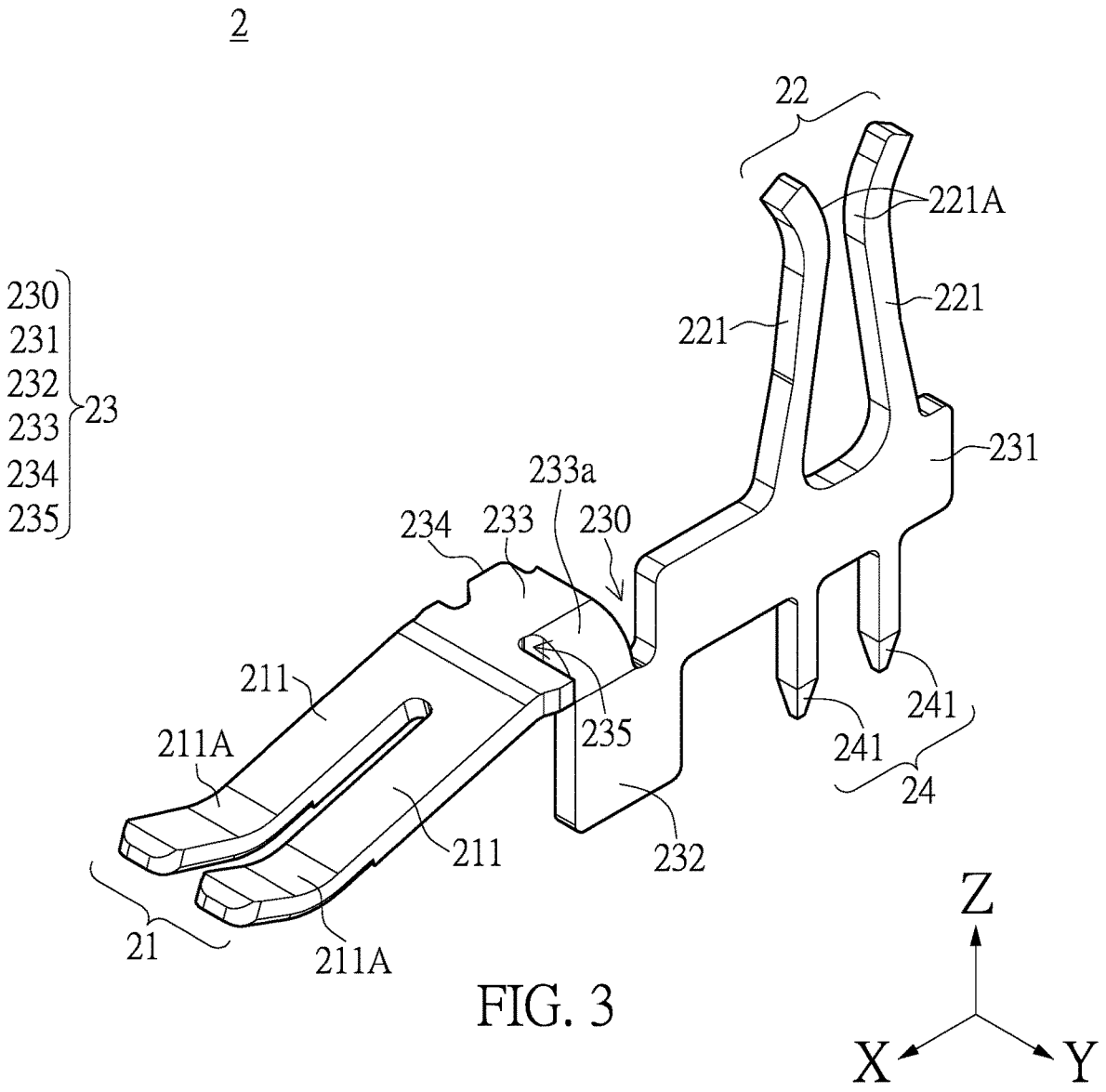
FIG. 3 is a three-dimensional schematic view of a second conductive terminal according to the first embodiment of the present disclosure.

Referring to FIG. 1 to FIG. 3, the first embodiment of the present disclosure provides a conductive terminal assembly T1, which includes a first conductive terminal 1 and a second conductive terminal 2. The first conductive terminal 1 and the second conductive terminal 2 are both integrally formed structures.

FIG. 2 shows the first conductive terminal 1 of this embodiment. The first conductive terminal 1 includes a first A contact portion 11, a first B contact portion 12, a first extension portion 13, and a first pin portion 14. The first A contact portion 11, the first B contact portion 12, and the first pin portion 14 are connected to the first extension portion 13. The first A contact portion 11 includes at least one first A contact arm 111. A quantity of the first A contact arms 111 is not limited in the present disclosure. This embodiment uses two first A contact arms 111 as an example. The first B contact portion 12 includes two first B contact arms 121. The first pin portion 14 includes a plurality of first pins 141. Quantities of the first B contact arms 121 and the first pins 141 are not limited in the present disclosure. The two first B contact arms 121 are mirror symmetrical or substantially mirror symmetrical in shape on opposite sides of a YZ plane. The two first A contact arms 111 extend along a first direction (a positive X-axis direction), the two first B contact arms 121 extend along a second direction (a positive Z-axis direction), and the plurality of first pins 141 extend along a third direction (a negative Z-axis direction). The first direction and the second direction are preferably perpendicular to each other. The second direction and the third direction are preferably parallel to each other. In addition, the two first A contact arms 111 each have a contact region 111A. Two opposite sides of the contact region 111A are circular arc sides, and the two contact regions 111A are preferably different in height in the Z-axis direction.

In continuation of the above, the first extension portion 13 includes a first main body region and a first turning region. The first main body region includes a first section 131 and a second section 132, and is substantially a plane. The first main body region extends along an XZ plane, and is connected between the first B contact portion 12 and the first pin portion 14. The first turning region is connected between the first main body region and the first A contact portion 11. The first turning region includes a third section 133. The first section 131 is connected between the first B contact portion 12 and the first pin portion 14. The second section 132 is connected between the first section 131 and the third section 133. The third section 133 is connected between the second section 132 and the first A contact portion 11. Further, the first extension portion 13 has a first notch 130, and the first notch 130 is located between the first section 131 and the second section 132. The second section 132 is bent at a right angle with respect to the first section 131 toward the negative Z-axis direction. The first turning region further has a first turning segment 133*a*, and the first turning segment 133*a* is bent at a right angle with respect to the second section 132 (the first main body region) toward the positive Y-axis direction. In addition, the first extension portion 13 further includes a first positioning member 134. The first positioning member 134 is a bump. The first positioning member 134 is located in the first turning region. The first positioning member 134 extends toward the positive Y-axis direction, and the first positioning member 134 and the second section 132 are respectively connected to two opposite sides of the third section 133. A first groove 135 is formed between the first A contact portion 11 and the first extension portion 13. The first groove 135 is adjacent to a bending region (that is, the first turning segment 133*a*) between the second section 132 and the third section 133. The first section 131 and the third section 133 are respectively connected to two opposite sides of the second section 132 in the Z-axis direction (the second direction). The two first B contact arms 121 and the two first pins 141 are respectively located on two opposite sides of the first section 131.

FIG. 3 shows the second conductive terminal 2 of this embodiment. The second conductive terminal 2 includes a second A contact portion 21, a second B contact portion 22, a second extension portion 23, and a second pin portion 24. The second A contact portion 21, the second B contact portion 22, and the second pin portion 24 are connected to the second extension portion 23. The second A contact portion 21 includes at least one second A contact arm 211. A quantity of the second A contact arms 211 is not limited in the present disclosure. In this embodiment, two second A contact arms 211 are used as an example. The second B contact portion 22 includes two second B contact arms 221. The second pin portion 24 includes a plurality of second pins 241. Quantities of the second B contact arms 221 and the second pins 241 are not limited in the present disclosure. The two second B contact arms 221 are mirror symmetrical or substantially mirror symmetrical in shape on opposite sides of the YZ plane. The two second A contact arms 211 extend along the first direction (the positive X-axis direction). The plurality of second B contact arms 221 extend along the second direction (the positive Z-axis direction). The two second pins 241 extend along the third direction (the negative Z-axis direction). In addition, the two second A contact arms 211 each have a contact region 211A. Two opposite sides of the contact region 211A are circular arc sides, and the two contact regions 211A are preferably different in height in the Z-axis direction.

In continuation of the above, the second extension portion 23 includes a second main body region and a second turning region. The second main body region includes a fourth section 231 and a fifth section 232, and is substantially a plane. The second main body region extends along the XZ plane, and is connected between the second B contact portion 22 and the second pin portion 24. The second turning region is connected between the second main body region and the second A contact portion 21. The second turning region includes a sixth section 233. The fourth section 231 is connected between the second B contact portion 22 and the second pin portion 24. The fifth section 232 is connected between the fourth section 231 and the sixth section 233. The sixth section 233 is connected between the fifth section 232 and the second A contact portion 21. The second extension portion 23 has a second notch 230. The second notch 230 is located between the fourth section 231 and the fifth section 232. The fifth section 232 is bent at a right angle with respect to the fourth section 231 toward the negative Z-axis direction. The second turning region further has a second turning segment 233*a*. The second turning segment 233*a* is bent at a right angle with respect to the fifth section 232 (the second main body region) toward the negative Y-axis direction. In addition, the second extension portion 23 further includes a second positioning member 234. The second positioning member 234 is a bump. The second positioning member 234 is located in the second turning region and extends toward the negative Y-axis direction, and the second positioning member 234 and the fifth section 232 are respectively connected to two opposite sides of the sixth section 233. A second groove 235 is formed between the second A contact portion 21 and the second extension portion 23. The second groove 235 is adjacent to a bending region (that is, the second turning segment 233*a*) between the fifth section 232 and the sixth section 233. The fourth section 231 and the sixth section 233 are connected to a same side of the fifth section 232. The two second B contact arms 221 and the two second pins 241 are respectively located on two opposite sides of the fourth section 231.

FIG. 1 shows that the first conductive terminal 1 and the second conductive terminal 2 are combined into the conductive terminal assembly T1. The first conductive terminal 1 and the second conductive terminal 2 are arranged side by side along the Y-axis direction, and the first conductive terminal 1 and the second conductive terminal 2 are not in contact with each other (with no physical contact). The second notch 230 and the first notch 130 are arranged side by side to form a limiting groove G. The conductive terminal assembly T1 may be fixed inside an electrical connector (referring to FIG. 13 first) through the design of the limiting groove G, the first positioning member 134, and the second positioning member 234. In addition, the first section 131 and the fourth section 231 are substantially higher than the first A contact portion 11 and the second A contact portion 21 in the positive Z-axis direction (the second direction). Therefore, the first extension portion 13 and the second extension portion 23 are more securely fixed inside the electrical connector by forming a positioning surface (along the XZ plane) on the first section 131 and the fourth section 231. In addition, the first positioning member 134 and the second positioning member 234 protrude more toward an outer side of the conductive terminal assembly (that is, toward the positive and negative Y-axis directions) than the second extension portion 23 and the first extension portion 13. That is, if a central plane (not shown in the figure) between the first section 131 and the fourth section 231 is defined on the XZ plane, on the positive Y-axis, a distance between an outermost end of the first positioning member 134 and the central plane is greater than a distance between an outermost end of the second extension portion 23 and the central plane; on the negative Y-axis, a distance between an outermost end of the second positioning member 234 and the central plane is greater than a distance between an outermost end of the first extension portion 13 and the central plane. In this way, the first positioning member 134 and the second positioning member 234 can provide additional positioning functions. Further, the two first A contact arms 111 of the first A contact portion 11 and the two second A contact arms 211 of the second A contact portion 21 are arranged opposite to each other in an up-and-down direction (in the Z-axis direction) and form a first port U1 for providing a mating surface parallel to an XY plane. The two first B contact arms 121 of the first B contact portion 12 and the two second B contact arms 221 of the second B contact portion 22 are arranged opposite to each other and form a second port U2 for providing a mating surface parallel to the YZ plane. Therefore, the first main body region of the first extension portion 13 and the second main body region of the second extension portion 23 are perpendicular to the mating surface of the first port U1, and are also perpendicular to the mating surface of the second port U2. The first port U1 may be used for an external electrical connector (or a power supply unit (PSU)) to be plugged in along the negative X-axis direction (that is, parallel to a direction of arrangement of the two first pins 141 and the two second pins 241). The external electrical connector (or the PSU) is plugged into the first port U1 to be in physical contact with the contact regions 111A of the first A contact arms 111 and the contact regions 211A of the second A contact arms 211. The second port U2 may be used for another external electrical connector to be plugged in along the negative Z-axis direction. The another external electrical connector is plugged into the second port U2 to be in physical contact with the contact regions 121A of the first B contact arm 121 and the contact regions 221A of the second B contact arm 221. The two first pins 141 of the first pin portion 14 and the two second pins 241 of the second pin portion 24 may be used for being plugged into an external circuit board. Among the contact regions 111A of the two first A contact arms 111 and the contact regions 211A of the two second A contact arms 211, a contact region distance between the contact regions 111A and 211A on a same side (one pair) is smaller than a contact region distance between the contact regions 111A and 211A on another same side (another pair). In other words, a contact region distance is defined between each first A contact pin 111 and a corresponding second A contact pin 211, and at least two adjacent ones of the contact region distance are different, so that an insertion force required for the external electrical connector (or the PSU) to perform mating can be reduced.

Second Embodiment

Figure 4:
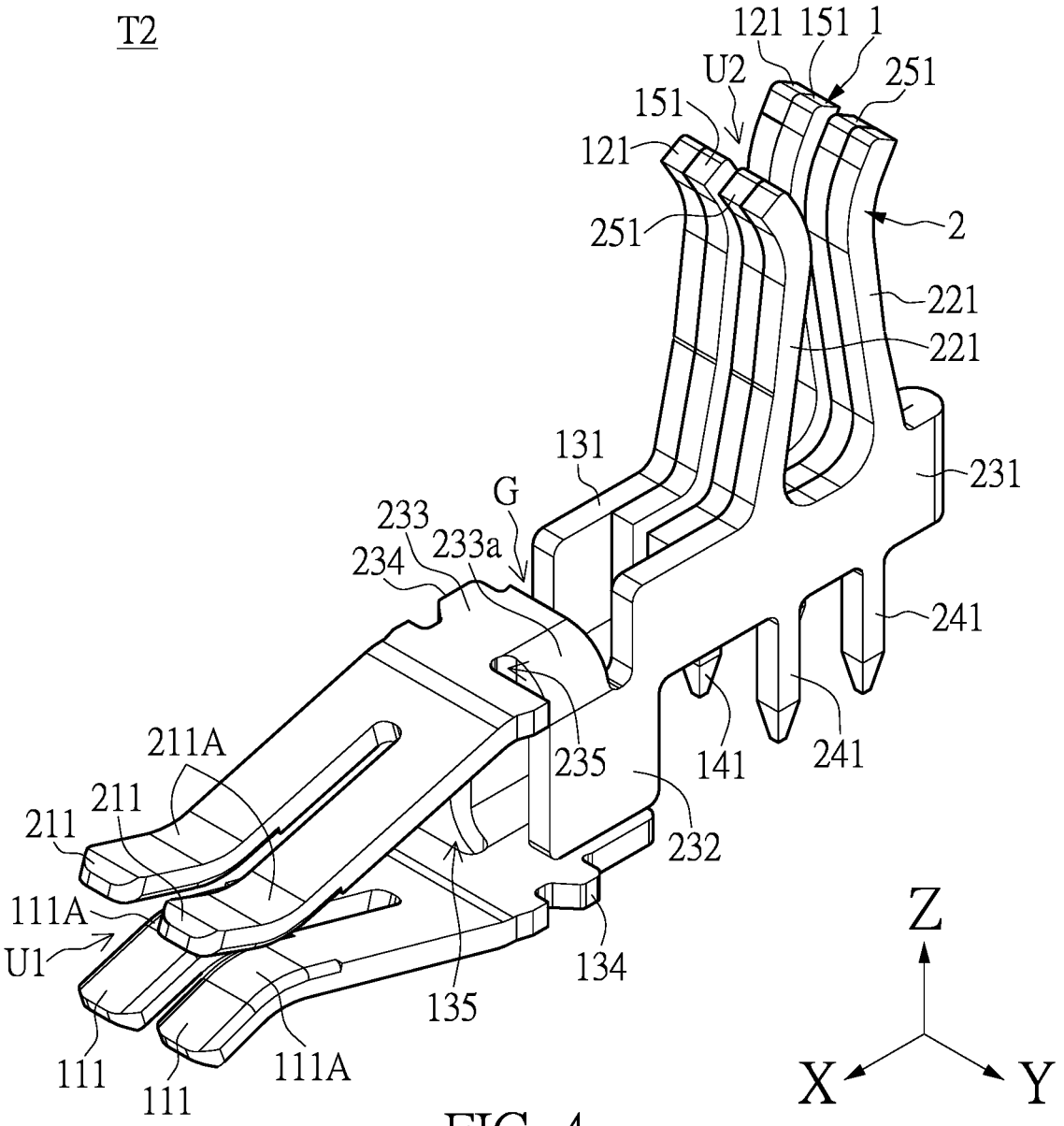
FIG. 4 is a three-dimensional schematic view of a conductive terminal assembly according to a second embodiment of the present disclosure.
Figure 5:
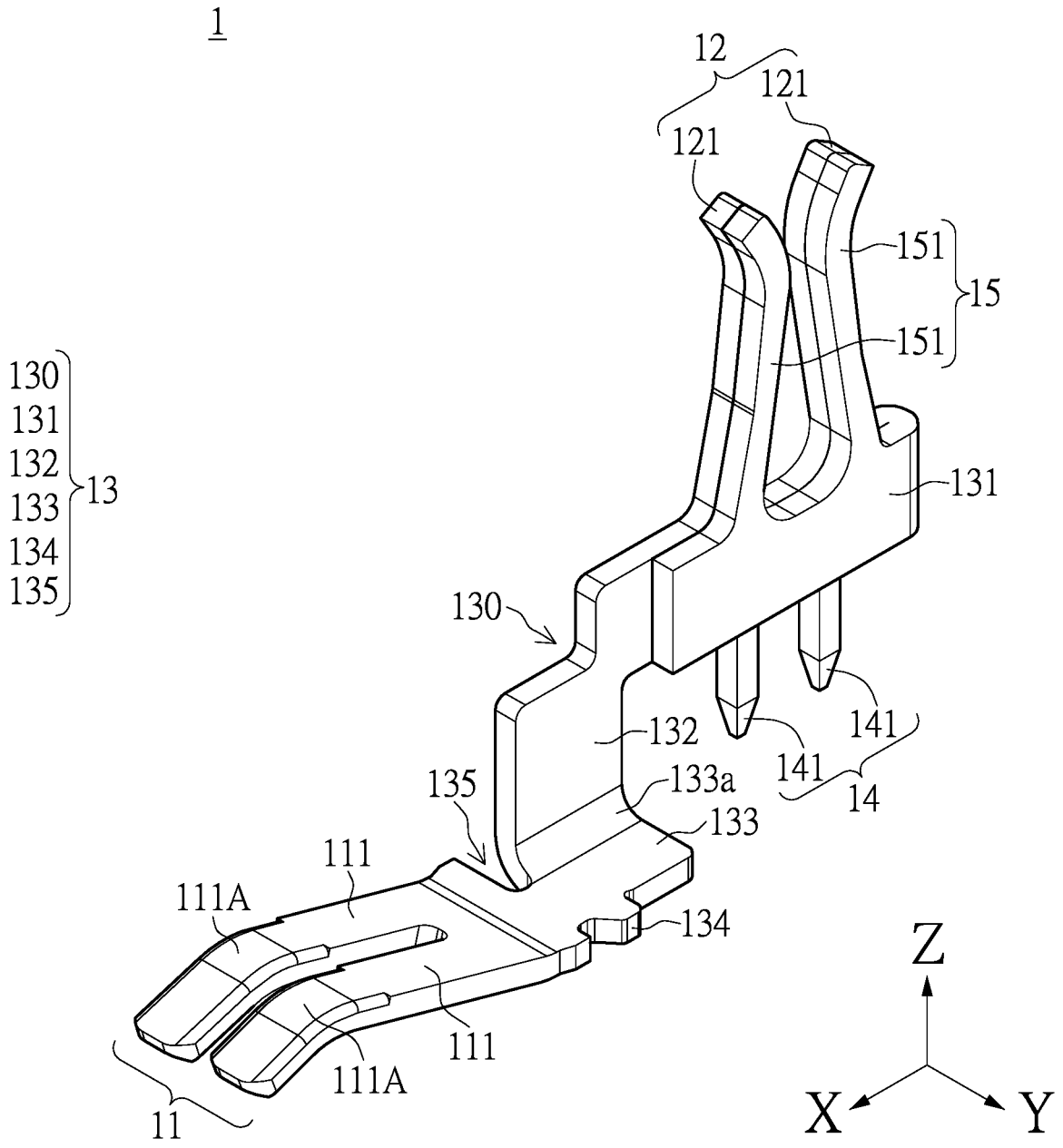
FIG. 5 is a three-dimensional schematic view of a first conductive terminal according to the second embodiment of the present disclosure.
Figure 6:
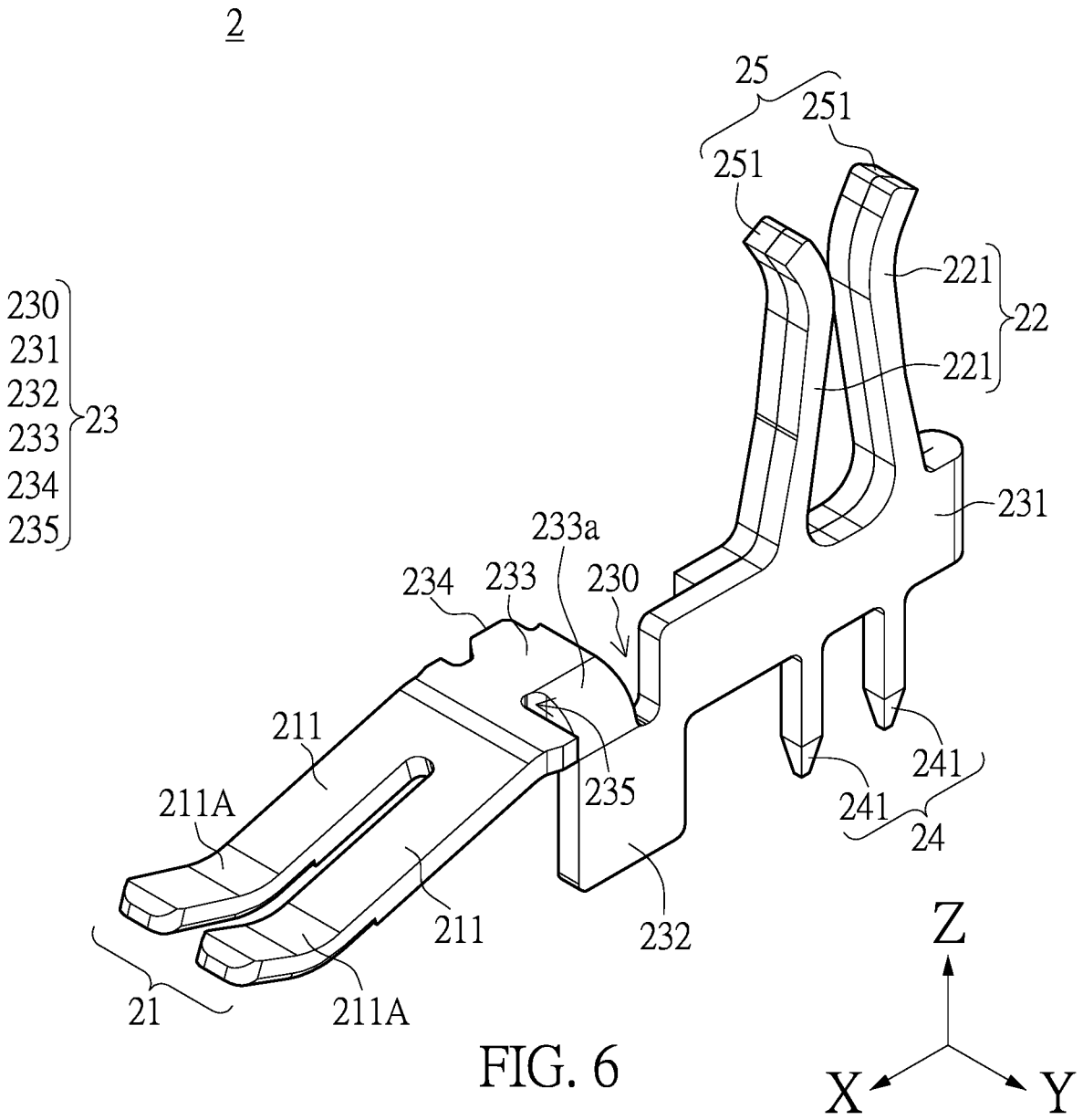
FIG. 6 is a three-dimensional schematic view of a second conductive terminal according to the second embodiment of the present disclosure.

Referring to FIG. 4, FIG. 5, and FIG. 6, the second embodiment of the present disclosure provides a conductive terminal assembly T2, which includes a first conductive terminal 1 and a second conductive terminal 2. The first conductive terminal 1 of the conductive terminal assembly T2 has a similar structure to the first conductive terminal 1 of the conductive terminal assembly T1, and the second conductive terminal 2 of the conductive terminal assembly T2 has a similar structure to the second conductive terminal 2 of the conductive terminal assembly T1. The similarities thereof are not described again.

As shown in FIG. 5, a difference between the first conductive terminal 1 of the conductive terminal assembly T2 and the first conductive terminal 1 of the conductive terminal assembly T1 lies in that the first conductive terminal 1 of the conductive terminal assembly T2 further includes a third B contact portion 15. Moreover, the first section 131 of the first extension portion 13 extends longer to form an elongated segment, and the third B contact portion 15 is connected to the elongated segment of the first section 131 and extends along the second direction (the positive Z-axis direction). Specifically, the third B contact portion 15 includes two third B contact arms 151 that are mirror symmetrical or substantially mirror symmetrical in shape on the two opposite sides of the YZ plane, and the first section 131 is folded (or in other words, the elongated segment of the first section 131 is bent toward the positive X-axis direction), so that the two first B contact arms 121 respectively overlap the two third B contact arms 151.

As shown in FIG. 6, the second conductive terminal 2 of the conductive terminal assembly T2 further includes a fourth B contact portion 25, the fourth section 231 of the second extension portion 23 extends longer, and the fourth B contact portion 25 is connected to an elongated segment of the fourth section 231 and extends along the second direction (the positive Z-axis direction). The fourth B contact portion 25 includes two fourth B contact arms 251 that are mirror symmetrical or substantially mirror symmetrical in shape on the two opposite sides of the YZ plane, and the fourth section 231 is folded (or in other words, the elongated segment of the fourth section 231 extends toward the positive X-axis direction), so that the two second B contact arms 221 respectively overlap the two fourth B contact arms 251. Referring to FIG. 4, the two first B contact arms 121 and the two third B contact arms 151 of the first B contact portion 12 are arranged opposite to the two second B contact arms 221 and the two fourth B contact arms 251 of the second B contact portion 22 and jointly form a second port U2 for providing a mating surface along the YZ plane. In the present disclosure, through the design of the two third B contact arms 151 and the two fourth B contact arms 251, a maximum current that the conductive terminal assembly can provide through the second port U2 is increased by increasing a contact area between the second port U2 and the external electrical connector.

Third Embodiment

Figure 7:
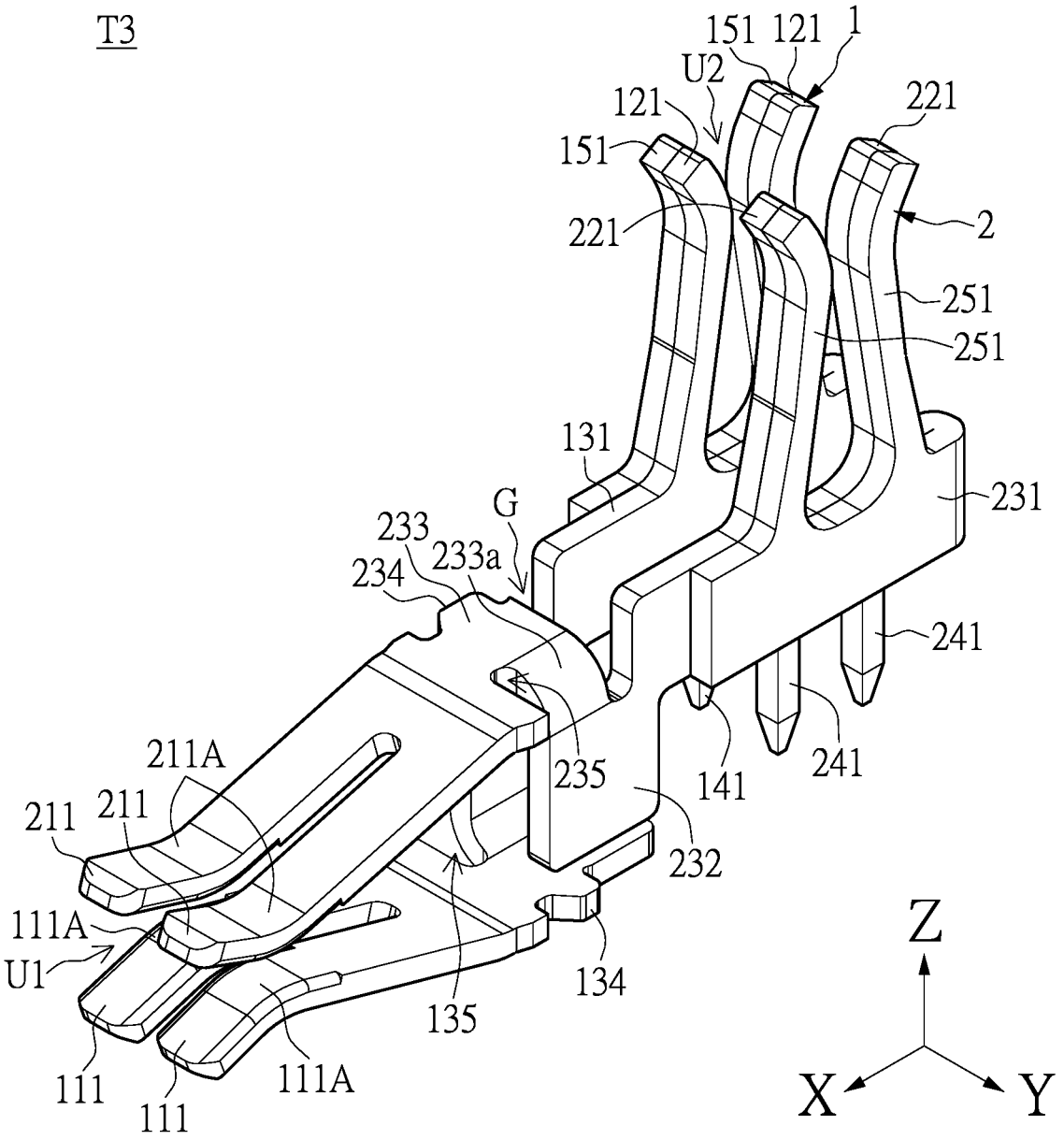
FIG. 7 is a three-dimensional schematic view of a conductive terminal assembly according to a third embodiment of the present disclosure.
Figure 8:
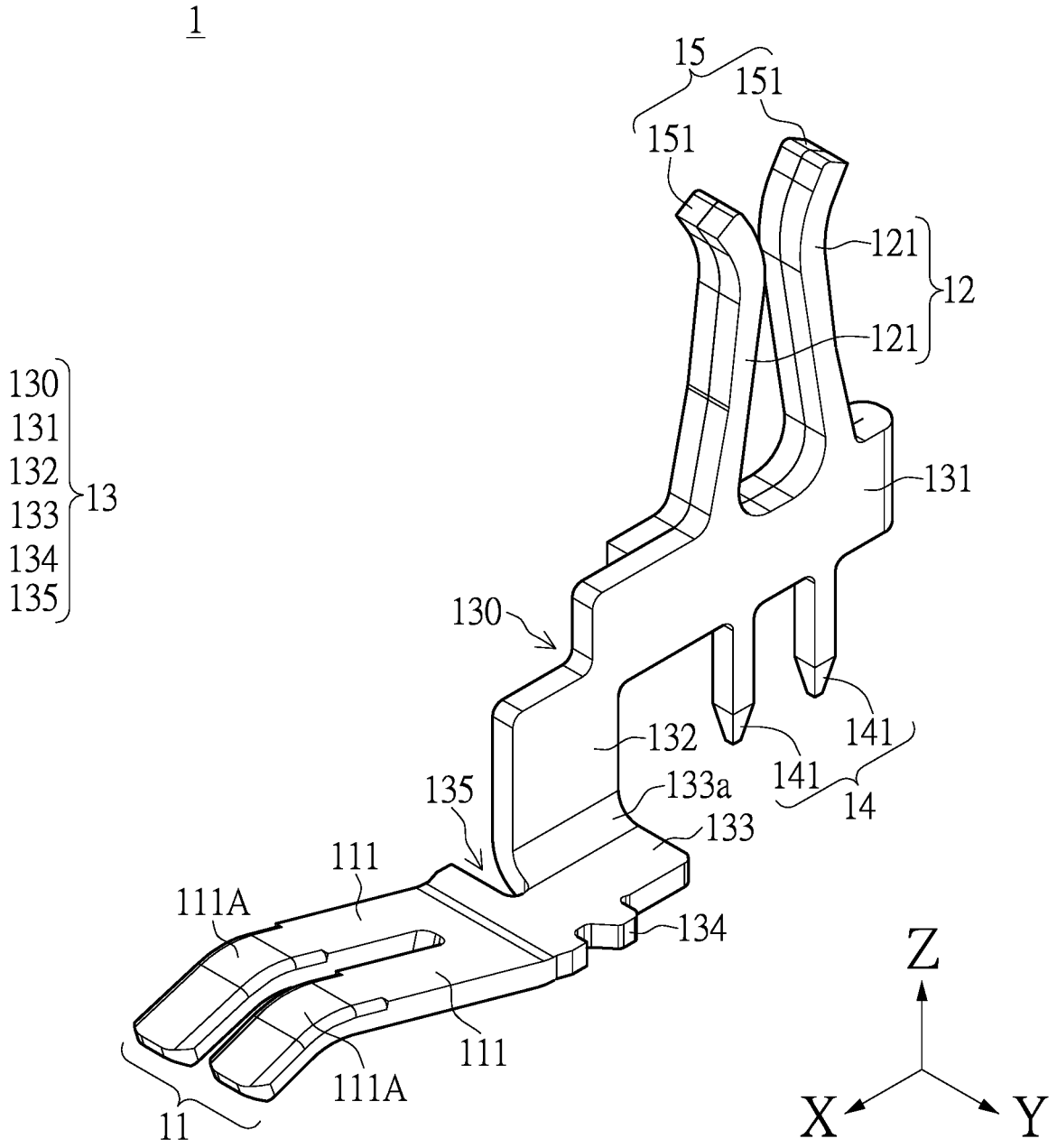
FIG. 8 is a three-dimensional schematic view of a first conductive terminal according to the third embodiment of the present disclosure.
Figure 9:
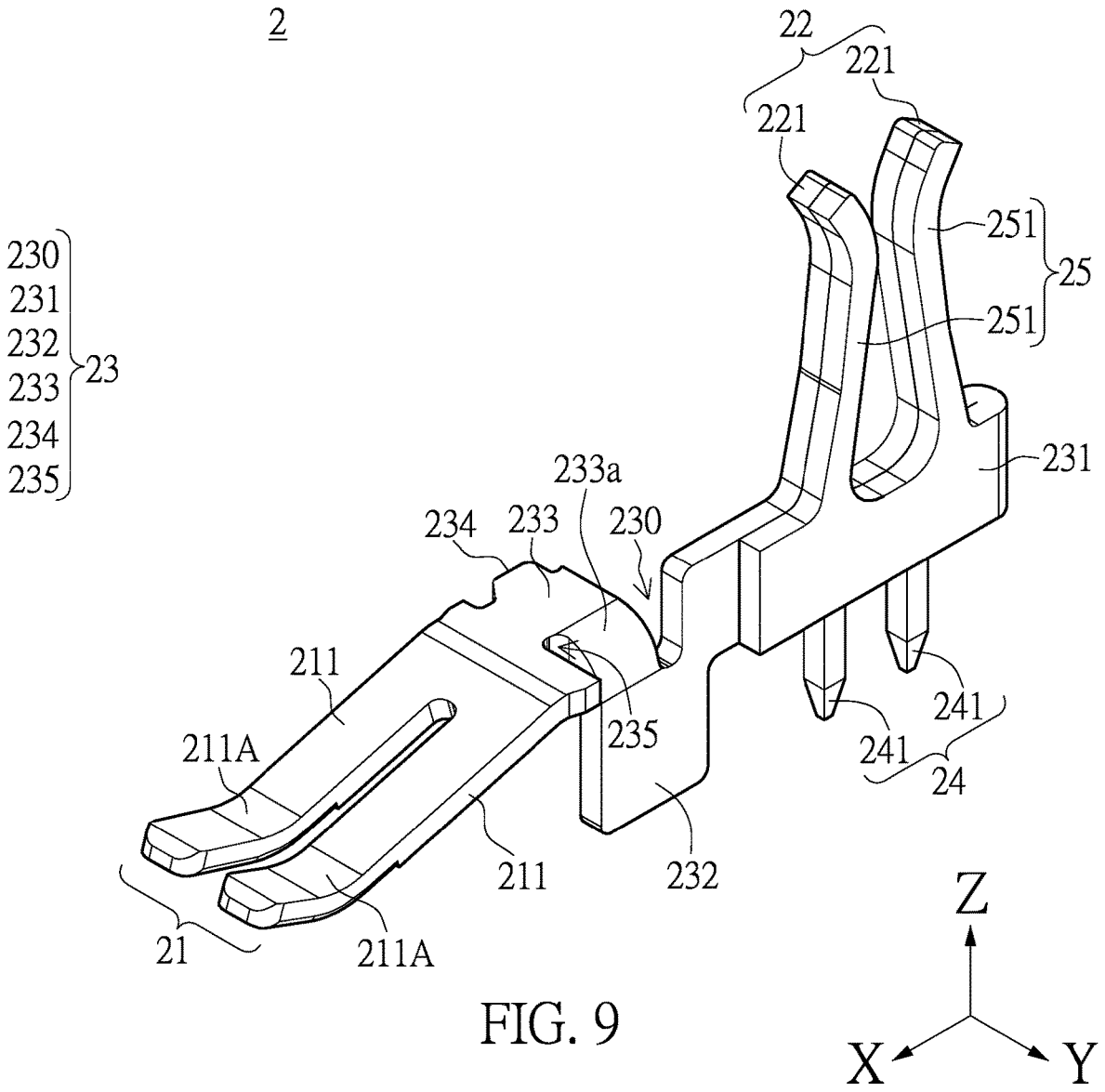
FIG. 9 is a three-dimensional schematic view of a second conductive terminal according to the third embodiment of the present disclosure.

Referring to FIG. 7, FIG. 8, and FIG. 9, the third embodiment of the present disclosure provides a conductive terminal assembly T3, which includes a first conductive terminal 1 and a second conductive terminal 2. The first conductive terminal 1 of the conductive terminal assembly T3 has a similar structure to the first conductive terminal 1 of the conductive terminal assembly T2, and the second conductive terminal 2 of the conductive terminal assembly T3 has a similar structure to the second conductive terminal 2 of the conductive terminal assembly T2. The similarities thereof are not described again.

As can be observed from a comparison of FIG. 7 and FIG. 4, in the conductive terminal assembly T2, the first section 131 of the first extension portion 13 of the first conductive terminal 1 and the fourth section 231 of the second extension portion 23 of the second conductive terminal 2 are bent toward an inner side of the conductive terminal assembly T2 (or in other words, the first section 131 and the fourth section 231 are folded toward a direction facing each other). Conversely, in the conductive terminal assembly T3, the first section 131 of the first extension portion 13 of the first conductive terminal 1 and the fourth section 231 of the second extension portion 23 of the second conductive terminal 2 are bent toward an outer side of the conductive terminal assembly T3 (or in other words, the first section 131 and the fourth section 231 are bent toward a direction facing away from each other).

It should be noted that the foregoing disclosures concerning the second and third embodiments are only two possible embodiments and are not intended to limit the present disclosure. In other embodiments, the first section 131 of the first extension portion 13 of the first conductive terminal 1 and the fourth section 231 of the second extension portion 23 of the second conductive terminal 2 can also be bent toward a same direction, such as being bent toward the positive Y-axis direction (e.g., a conductive terminal assembly T2' in FIG. 13) or being bent toward the negative Y-axis direction (e.g., a conductive terminal assembly T3' in FIG. 13). In addition, the first section 131 and the second section 231 may also be folded two or more times, and more overlapping B contact arms can be used to form the second port U2, so as to provide a larger current.

Fourth Embodiment

Figure 10:
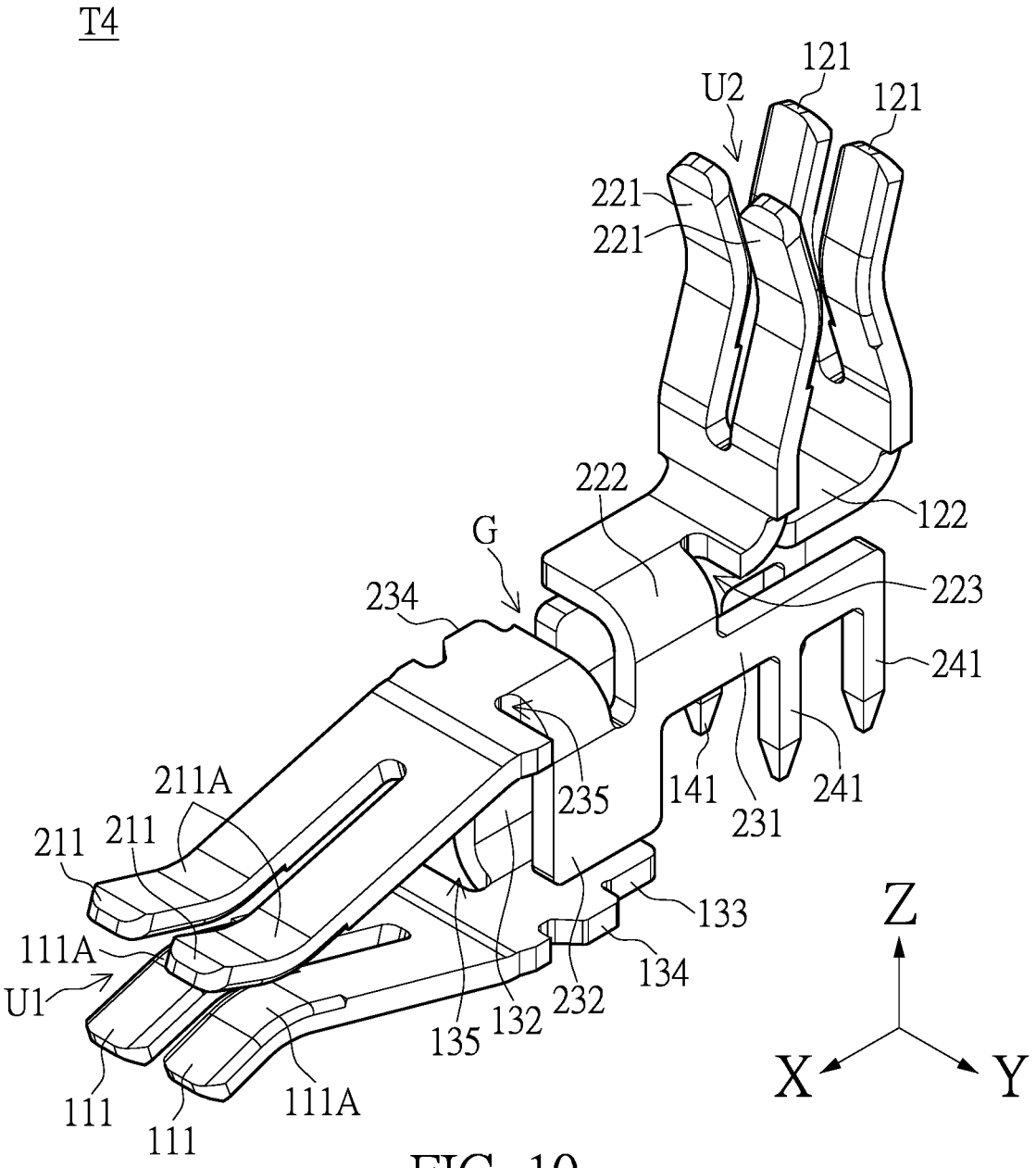
FIG. 10 is a three-dimensional schematic view of a conductive terminal assembly according to a fourth embodiment of the present disclosure.
Figure 11:
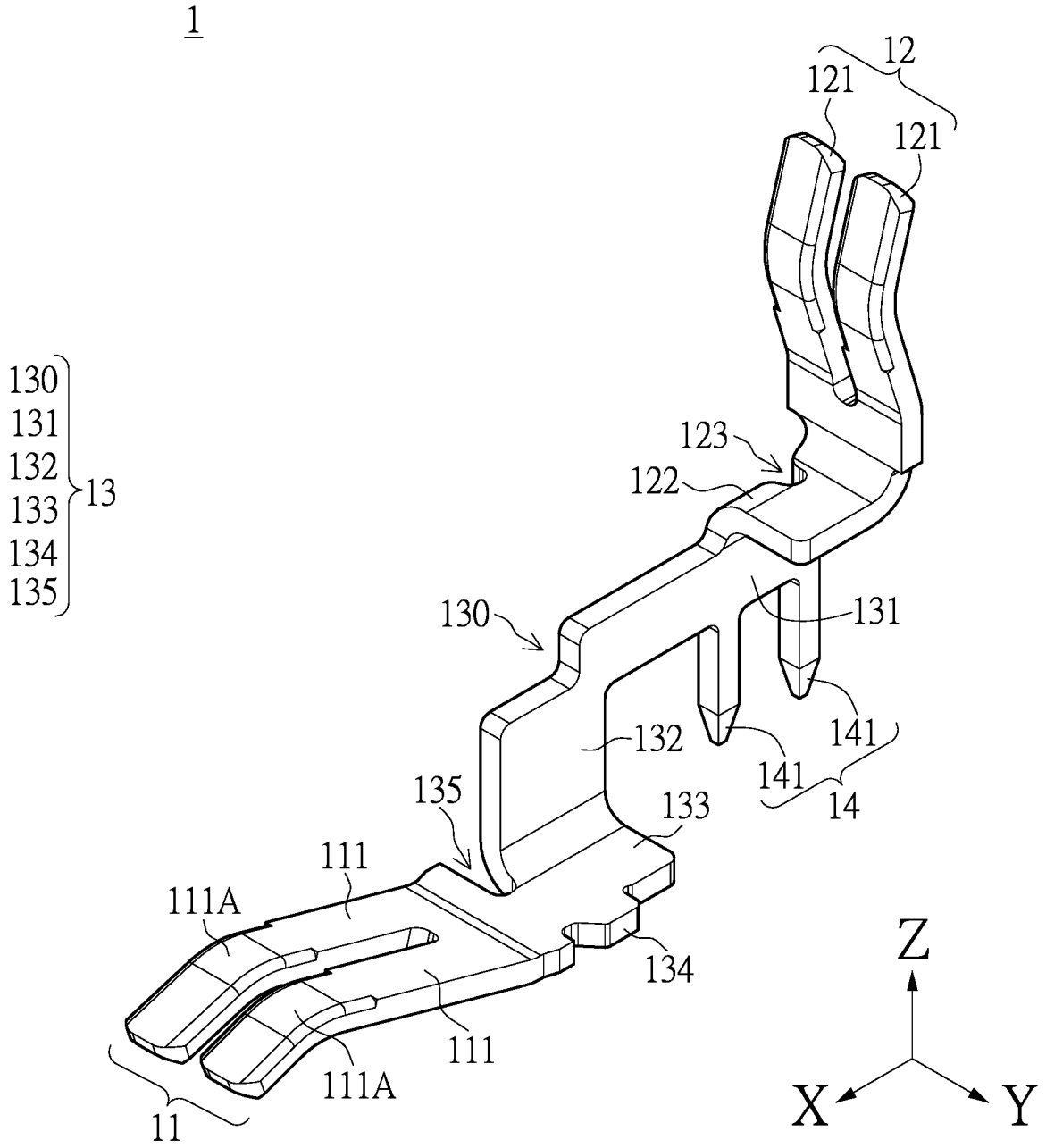
FIG. 11 is a three-dimensional schematic view of a first conductive terminal according to the fourth embodiment of the present disclosure.
Figure 12:
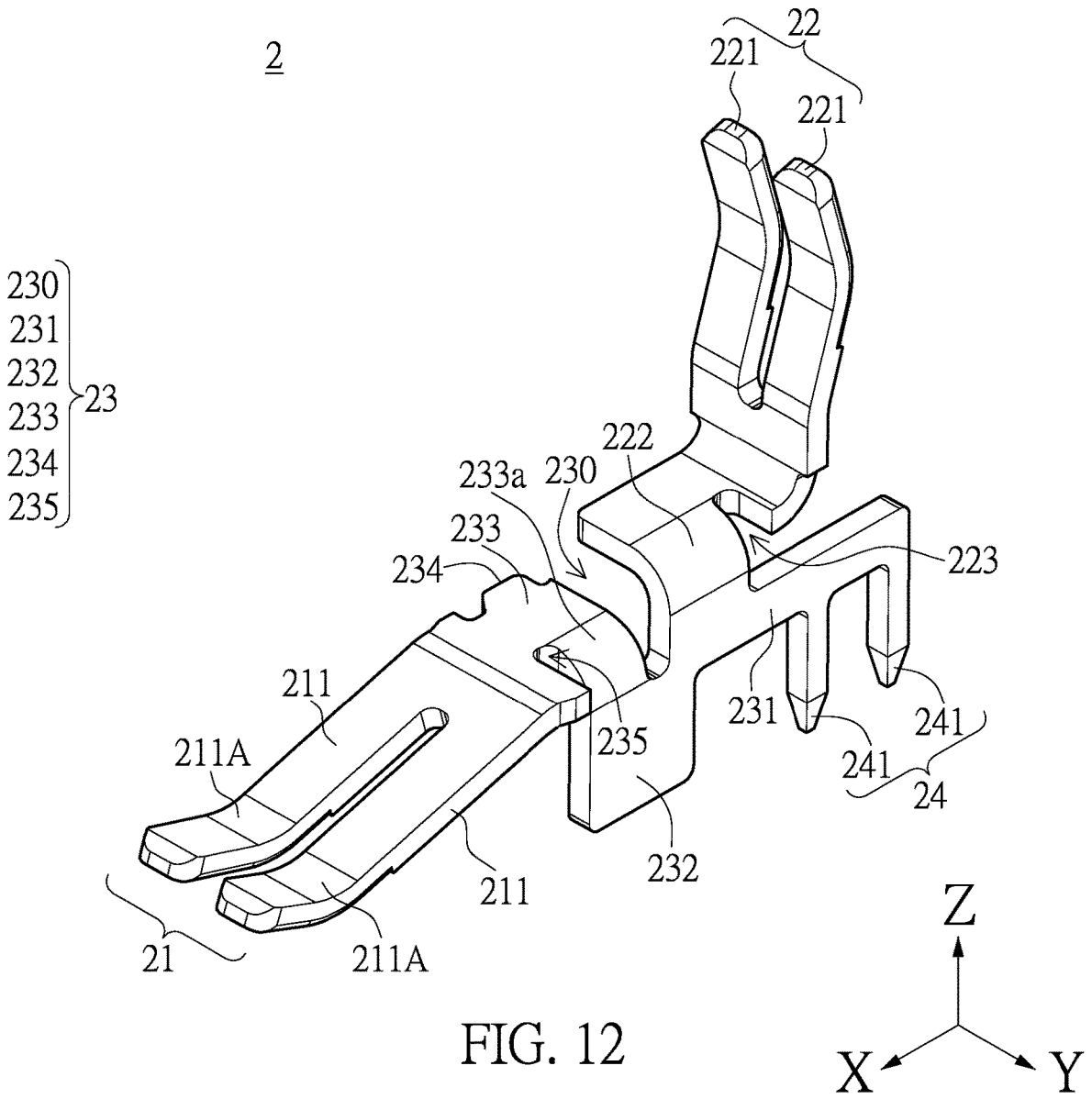
FIG. 12 is a three-dimensional schematic view of a second conductive terminal according to the fourth embodiment of the present disclosure.

Referring to FIG. 10 to FIG. 12, the fourth embodiment of the present disclosure provides a conductive terminal assembly T4, which includes a first conductive terminal 1 and a second conductive terminal 2. The first conductive terminal 1 of the conductive terminal assembly T4 has a similar structure to the first conductive terminal 1 of the conductive terminal assembly T1, and the second conductive terminal 2 of the conductive terminal assembly T4 has a similar structure to the second conductive terminal 2 of the conductive terminal assembly T1. The similarities thereof are not described again.

As shown in FIG. 11, a difference between the first conductive terminal 1 of the conductive terminal assembly T4 and the first conductive terminal 1 of the conductive terminal assembly T1 lies in that the first B contact portion 12 of the first conductive terminal 1 of the conductive terminal assembly T4 further includes a first bending segment 122, and the first bending segment 122 is connected between the first section 131 of the first extension portion 13 and the two first B contact arms 121 of the first B contact portion 12. The first bending segment 122 is bent toward the positive Y-axis direction with respect to the first section 131 of the first extension portion 13, and the two first B contact arms 121 are bent toward the positive Z-axis direction with respect to the first bending segment 122. In addition, a third groove 123 is located between the first bending segment 122 and the two first B contact arms 121, and is adjacent to the first bending segment 122.

As shown in FIG. 12, a difference between the second conductive terminal 2 of the conductive terminal assembly T4 and the second conductive terminal 2 of the conductive terminal assembly T1 lies in that the second B contact portion 22 of the second conductive terminal 2 of the conductive terminal assembly T4 further includes a second bending segment 222, and the second bending segment 222 is connected between the fourth section 231 of the second extension portion 23 and the two second B contact arms 221 of the second B contact portion 22. The second bending segment 222 is bent toward the negative Y-axis direction with respect to the fourth section 231, and the two second B contact arms 221 are bent toward the positive Z-axis direction with respect to the second bending segment 222. In addition, a fourth groove 223 is formed between the second bending segment 222 and the two second B contact arms 221, and the fourth groove 223 is adjacent to the second bending segment 222.

Further, as shown in FIG. 10, when the first conductive terminal 1 and the second conductive terminal 2 form the conductive terminal assembly T4, the second B contact portion 22 and the first B contact portion 21 are arranged side by side along the first direction (the positive X-axis direction) and form a second port U2 for providing a mating surface parallel to the YZ plane. In addition, due to the design of the first bending segment 122 and the second bending segment 222, the two first B contact arms 121 and the two second B contact arms 221 in this embodiment are arranged along the Y-axis (in contrast, the two first B contact arms 121 and the two second B contact arms 221 in the conductive terminal assembly T1 are arranged along the X-axis) and are mirror symmetrical.

Figure 13:
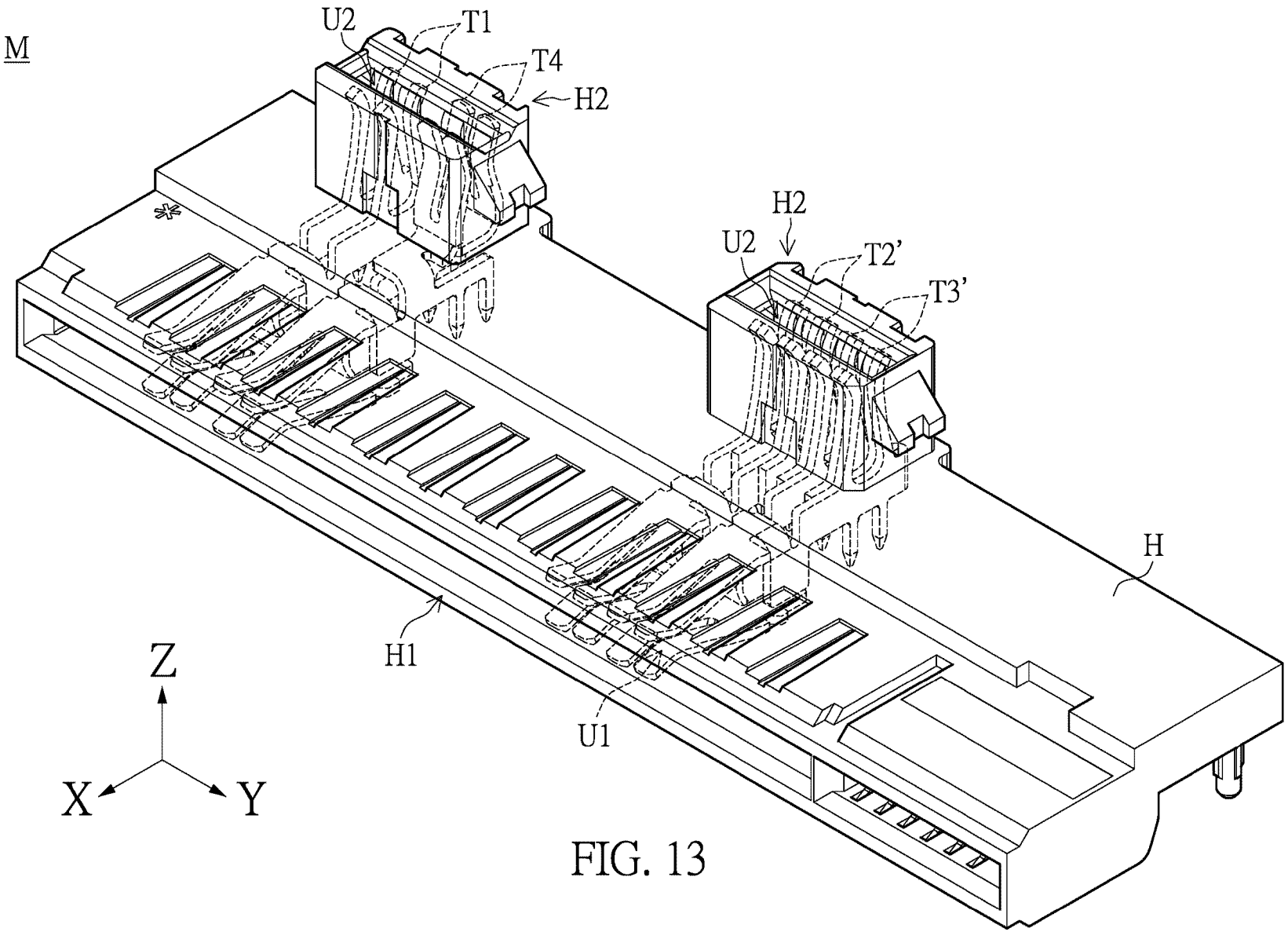
FIG. 13 is a three-dimensional schematic view of an electrical connector according to the present disclosure.
Figure 14:
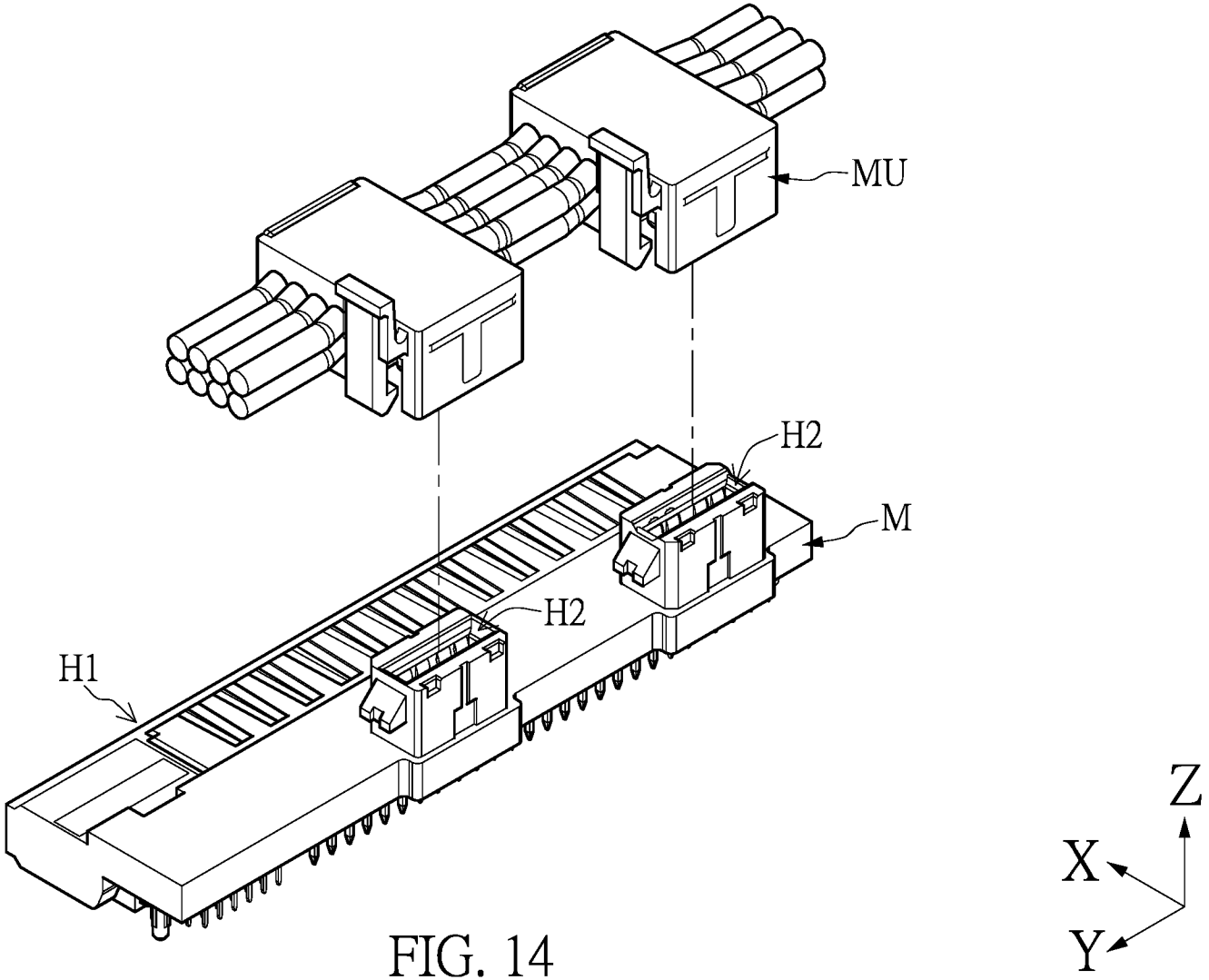
FIG. 14 is a schematic exploded view of the electrical connector, a first mating assembly, and a second mating assembly according to the present disclosure.
Figure 15:
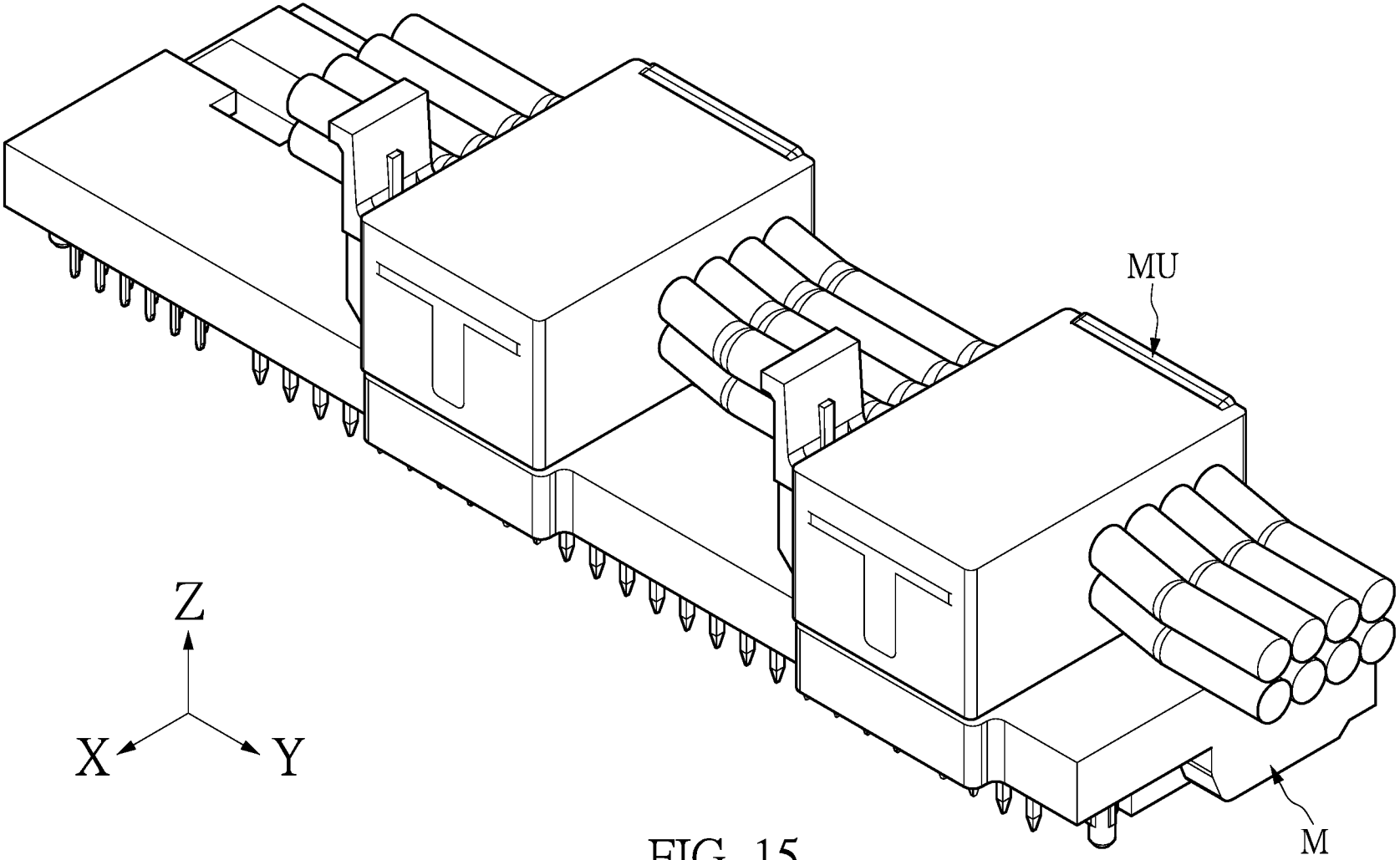
FIG. 15 is a schematic diagram of the electrical connector being connected to the first mating assembly and the second mating assembly according to the present disclosure.

Then, referring to FIG. 13 to FIG. 15, the present disclosure provides an electrical connector M, which includes a housing H and a plurality of conductive terminal assemblies. Any one of the plurality of conductive terminal assemblies can be the conductive terminal assembly T1, T2, T3, or T4 (or T2' and T3') in the foregoing first to fourth embodiments. The housing H has a slot H1 and at least one jack H2 (two jacks H2 are exemplarily illustrated in the figures, but the present disclosure is not limited thereto). The slot H1 faces the first direction (positive X-axis direction) and corresponds to the first port U1; that is, the slot H1 communicates with the first port U1. The jack H2 faces the second direction (positive Z-axis direction) and corresponds to the second port U2; that is, the jack H2 communicates with the second port U2.

In continuation of the above, both the slot H1 and the jack H2 are used as plug-in input interfaces for electrical connection of a mating component. For example, the slot H1 may be a card edge or a plug-in input interface of a power-supply board, which is provided for a first mating assembly (not shown in the figure) to be plugged in along a plug-in direction (negative X-axis). The first mating assembly may be, for example, a card edge interface of an output terminal of the PSU. The first mating assembly is inserted into the slot H1, and then is further plugged into the first port U1, so as to be electrically connected to the conductive terminal assembly (T1 to T4). In addition, each jack H2 may be used for a second mating assembly MU to be plugged in (hence, multiple ones of the jack H2 may be used for multiple ones of the second mating assembly MU to be plugged in). The second mating assembly MU may be, for example, an external electrical connector with a cable or a bus bar. The second mating assembly MU is inserted into the slot H1, and then is further plugged into the second port U2, so as to be electrically connected to the conductive terminal assembly (T1 to T4). In addition, the first pin portion 14 and the second pin portion 24 are used for being plugged into a circuit board (not shown in the figure). As described in the foregoing embodiment, each conductive terminal assembly provides a plurality of pins that are arranged along the X-axis and are parallel with a plug-in direction of the first port U1.

Therefore, the electrical connector M of the present disclosure is actually a shunt connector, which can transmit power (or a signal) provided by the first mating assembly (such as a PSU) to multiple ones of the second mating assembly MU through the plurality of conductive terminal assemblies, so as to shunt a current or transfer the signal.

Beneficial Effects of the Embodiments

In conclusion, in the conductive terminal assembly and the conductive terminal provided by the present disclosure, the first A contact portion and the second A contact portion are arranged side by side and form the first port for the first mating assembly to be plugged in, the first B contact portion and the second B contact portion are arranged side by side and form the second port for the second mating assembly to be plugged in, and the first pin portion and the second pin portion are used for being plugged into the circuit board, so as to provide an electrical connector with a conductive terminal assembly capable of performing a current shunting function, which can additionally shunt a current to other components in a single electrical connector. Therefore, the electrical connector provided in the present disclosure is an improvement compared with the conventional electrical connector that usually transmits a current through only a single output interface. If the electrical connector provided in the present disclosure (instead of the conventional electrical connector) is disposed in an electronic apparatus, space of the electronic apparatus can be effectively saved.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A conductive terminal assembly, comprising:

a first conductive terminal that includes a first A contact portion, a first B contact portion, a first extension portion, and a first pin portion, the first A contact portion, the first B contact portion, and the first pin portion being connected to the first extension portion, the first A contact portion including at least one first A contact arm, the at least one first A contact arm extending along a first direction, the first B contact portion extending along a second direction, the first pin portion extending along a third direction, the first direction being perpendicular to the second direction and the third direction, and the second direction and the third direction being parallel to each other and in opposite directions; and a second conductive terminal that is arranged side by side with the first conductive terminal, the second conductive terminal including a second A contact portion, a second B contact portion, a second extension portion, and a second pin portion, the second A contact portion, the second B contact portion, and the second pin portion being connected to the second extension portion, the second A contact portion including at least one second A contact arm, the at least one second A contact arm extending along the first direction, the second B contact portion extending along the second direction, and the second pin portion extending along the third direction;

wherein the first conductive terminal and the second conductive terminal are each integrally formed and not in contact with each other, the first A contact portion and the second A contact portion are arranged side by side and form a first port, the first port is used for a first mating assembly to be plugged in, the first B contact portion and the second B contact portion are arranged side by side and form a second port, the second port is used for a second mating assembly to be plugged in and receive power or signal provided by the first mating assembly, and the first pin portion and the second pin portion are used for being plugged into a circuit board.

2. The conductive terminal assembly according to claim 1, wherein the first extension portion includes a first main body region and a first turning region, the first main body region connects to the first B contact portion and the first pin portion, the first turning region connects to the first main body region and the first A contact portion, and the first turning region has a first turning segment that is bent.

3. The conductive terminal assembly according to claim 1, wherein the first extension portion has a first notch, a first section, a second section, and a third section, the first section is connected between the first B contact portion and the first pin portion, the second section is connected between the first section and the third section, the first notch is located between the first section and the second section, and the third section is bent at a right angle with respect to the second section.

4. The conductive terminal assembly according to claim 3, wherein the first conductive terminal further includes a third B contact portion, the third B contact portion is connected to the first section and extends along the second direction, the first B contact portion includes two first B contact arms that are substantially mirror symmetrical in shape, the third B contact portion includes two third B contact arms that are substantially mirror symmetrical in shape, and the first section is folded so that the two first B contact arms respectively overlap the two third B contact arms.

5. The conductive terminal assembly according to claim 3, wherein the second extension portion has a second notch, a fourth section, a fifth section, and a sixth section, the fourth section is connected between the second B contact portion and the second pin portion, the fifth section is connected between the fourth section and the sixth section, the second notch is located between the fourth section and the fifth section, the sixth section is bent at a right angle with respect to the fifth section, and the second notch and the first notch are arranged opposite to each other to form a limiting groove.

6. The conductive terminal assembly according to claim 5, wherein the first section and the third section are respectively connected to two opposite sides of the second section in the second direction, and the fourth section and the sixth section are connected to a same side of the fifth section.

7. The conductive terminal assembly according to claim 5, wherein the first extension portion further includes a first positioning member, a central plane is defined between the first section and the fourth section, and a distance between an outermost end of the first positioning member and the central plane is greater than a distance between an outermost end of the second extension portion and the central plane.

8. The conductive terminal assembly according to claim 3, wherein the second extension portion has a second notch, a fourth section, a fifth section, and a sixth section, the fourth section is connected between the second B contact portion and the second pin portion, the fifth section is connected between the fourth section and the sixth section, the second notch is located between the fourth section and the fifth section, the sixth section is bent at a right angle with respect to the fifth section, and heights of the first section and the fourth section in the second direction are higher than heights of the first A contact portion and the second A contact portion.

9. The conductive terminal assembly according to claim 1, wherein the first pin portion has a plurality of first pins extending along the third direction and arranged along the first direction, and the second pin portion has a plurality of second pins extending along the third direction and arranged along the first direction.

10. The conductive terminal assembly according to claim 1, wherein a plurality of first A contact pins and a plurality of second A contact pins are provided, a contact region distance is defined between each of the first A contact pins and a corresponding one of the second A contact pins, and at least two adjacent ones of the contact region distance are different.

11. A conductive terminal assembly, comprising:

an A contact portion including at least one A contact arm, the at least one A contact arm extending along a first direction;

a B contact portion including a plurality of B contact arms, the B contact arms extending along a second direction;

a pin portion extending along a third direction; and an extension portion connected to the A contact portion, the B contact portion, and the pin portion;

wherein the A contact portion, the B contact portion, the extension portion, and the pin portion are integrally formed, the first direction is perpendicular to the second direction and the third direction, and the second direction and the third direction are parallel to each other and in opposite directions.

12. The conductive terminal according to claim 11, wherein the extension portion includes a main body region and a turning region, the main body region connects to the B contact portion and the pin portion, the turning region connects to the main body region and the A contact portion, and the turning region has a turning segment that is bent.

13. The conductive terminal according to claim 12, wherein a groove is formed between the A contact portion and the extension portion, and the groove is adjacent to the turning segment.

14. The conductive terminal according to claim 12, wherein the pin portion has a plurality of pins arranged along the first direction.

15. The conductive terminal according to claim 12, wherein the extension portion further has a first notch, the main body region is a plane and includes a first section and a second section, the first notch is located between the first section and the second section, the turning region includes a third section, the first section is connected between the B contact portion and the pin portion, the second section is connected between the first section and the third section, and the third section is connected between the second section and the A contact portion.

16. The conductive terminal according to claim 15, wherein the first section and the third section are respectively connected to two opposite sides of the second section in the second direction.

17. The conductive terminal according to claim 15, wherein the extension portion further includes a positioning member, and the positioning member and the second section are respectively connected to two opposite sides of the third section.

18. The conductive terminal according to claim 12, wherein the extension portion further has a second notch, the main body region is a plane and includes a fourth section and a fifth section, the second notch is located between the fourth section and the fifth section, the turning region includes a sixth section, the fourth section is connected between the B contact portion and the pin portion, the fifth section is connected between the fourth section and the sixth section, the sixth section is connected between the fifth section and the A contact portion, and the fourth section and the sixth section are connected to a same side of the fifth section in the second direction.

19. The conductive terminal according to claim 15, further comprising another B contact portion, wherein the another B contact portion is connected to the first section and extends along the second direction, each of the two B contact portions includes two of the B contact arms that are substantially mirror symmetrical in shape, and the first section is folded so that the two B contact arms of the two B contact portions overlap each other.

20. The conductive terminal according to claim 11, wherein the B contact portion includes a bending segment, and the bending segment is connected between the extension portion and the B contact arms.

* * * * *